United States Patent [19]

Bastle

[11] Patent Number: 5,026,022

[45] Date of Patent: Jun. 25, 1991

[54] THERMOSTATIC EXPANSION VALVE FOR LOW REFRIGERANT FLOW RATES

[75] Inventor: Clifford F. Bastle, Gurnee, Ill.

[73] Assignee: Parker Hannifin Corporation, Cleveland, Ohio

[21] Appl. No.: 576,243

[22] Filed: Aug. 28, 1990

[51] Int. Cl.[5] ..... F16K 1/52; F16K 47/04

[52] U.S. Cl. ..... 251/122; 251/337; 62/225

[58] Field of Search ..... 251/122, 337, 339; 62/225, 224

[56] References Cited

U.S. PATENT DOCUMENTS

| | | | |
|---|---|---|---|
| 1,510,802 | 10/1924 | Scott | 251/121 |
| 2,231,163 | 2/1941 | Johnson | 62/225 X |
| 2,298,253 | 10/1942 | Dillman et al. | 251/337 |
| 2,452,956 | 11/1948 | Robins | 251/122 |

FOREIGN PATENT DOCUMENTS

| | | | |
|---|---|---|---|
| 484369 | 5/1938 | United Kingdom | 251/121 |

*Primary Examiner*—Arnold Rosenthal
*Attorney, Agent, or Firm*—Ralph E. Jocke

[57] ABSTRACT

A thermostatic expansion valve adapted for refrigerant flow at low flow rates includes a body (12) with an inlet (14) and an outlet (16). The body includes an orifice (24) and a cylindrical chamber (20). A movable metering pin (26) includes a needle head portion (28) which is movable into said orifice. A power element assembly (46) is operative to move the metering pin to enable refrigerant flow through the orifice. The metering pin also includes a cylindrical body portion (30) positioned in the cylindrical chamber of the body. An outer wall of the cylindrical body portion of the metering pin is disposed from an inner wall of the cylindrical chamber to form an accurately sized yet very small opening. The valve enables accurate superheat control at low flow rates through the valve.

9 Claims, 2 Drawing Sheets

THERMOSTATIC EXPANSION VALVE FOR LOW REFRIGERANT FLOW RATES

TECHNICAL FIELD

This invention relates to thermostatic expansion valves. Particularly, this invention relates to a thermostatic expansion valve which provides superheat control at low refrigerant flow rates in a small capacity mechanical refrigeration system.

BACKGROUND ART

Various specialized cooling applications require refrigeration systems with very low capacities. A system having a capacity in the range of one-tenth ton (350 watts) which uses common refrigerants such as R12, R134A, R22 or R502, requires a thermostatic expansion valve that regulates refrigerant flow within a range of very low flow rates.

Conventional thermostatic expansion valves designed for use in much larger systems, use a single needle/ball and orifice combination to regulate refrigerant flow. The proximity of the needle to the orifice is controlled to regulate the amount of refrigerant that passes through the orifice. The flow area of the orifice in a refrigeration system having a capacity of one-fourth ton (900 watts) or less, is extremely small. It is not feasible to economically build an expansion valve for such a small system that uses a single needle/ball and orifice construction.

One approach that has been taken to produce a thermostatic expansion valve for a system which operates at a low refrigerant flow rate is to provide a valve in which the refrigerant undergoes double expansion. In valves of this type, the refrigerant is first expanded through a conventional needle/orifice. Thereafter the refrigerant is passed through a second, extremely small, metering orifice. Such a valve has been previously produced by the Danfoss Company. The drawback of this prior art construction is that it is difficult to achieve a precisely sized metering orifice having an area necessary to achieve the desired flow range. This makes the valve difficult to produce, imprecise in controlling refrigerant flow and expensive.

Thus, there exists a need for a thermostatic expansion valve that may be used in low capacity mechanical refrigeration systems, that precisely controls refrigerant flow and which is less expensive to produce.

DISCLOSURE OF INVENTION

It is an object of the present invention to provide a thermostatic expansion valve that is suitable for use in small capacity refrigeration and air conditioning systems.

It is a further object of the present invention to provide a thermostatic expansion valve that controls the flow of refrigerant within a range of very low flow rates.

It is a further object of the present invention to provide a thermostatic expansion valve for low flow rates that is more reliable and precise in controlling flow.

It is a further object of the present invention to provide a thermostatic expansion valve for a small capacity refrigeration or air conditioning system that is easier to manufacture and less expensive to produce.

It is a further object of the present invention to provide a thermostatic expansion valve that may be readily adapted to other small systems having different flow rates.

Further objects of the present invention will be made apparent in the following Best Modes for Carrying Out Invention and the appended claims.

The foregoing objects are achieved by a thermostatic expansion valve having a body which includes an inlet and an outlet. The body includes an orifice in the refrigerant flow path between the inlet and the outlet. The body also includes a cylindrical chamber coaxial with the orifice and between the orifice and the outlet.

A metering pin is movably mounted in the cylindrical chamber. The metering pin includes a needle head portion at a first end adjacent the orifice. The metering pin further includes a cylindrical portion positioned in the cylindrical chamber. The cylindrical portion of the metering pin is slightly smaller in diameter than the cylindrical chamber, thereby forming an accurately sized flow opening between an outer wall of the pin and an inner wall of the chamber.

The metering pin is supported at a second end by retaining means which includes a retaining member and a spring which biases the metering pin towards the orifice. An adjusting member accessible through the outlet of the valve is adjustable to set the force applied by the spring to the metering pin, and thus the superheat of the refrigerant in the system downstream of the valve.

The body also includes a conventional power element assembly which is connected to a piston. The piston is movable in the body coaxial with the orifice and the metering pin. The piston includes a pointed conical portion which contacts the needle head and is operative to move the metering pin in response to the power element assembly.

The cylindrical chamber and the cylindrical portion of the metering pin are formed using conventional manufacturing methods which maintain relatively close tolerances, but which may be achieved economically. The opening between the wall of the cylindrical chamber and the pin is very small and provides for a precisely determined flow area through the valve. This enables the valve of the present invention to accurately control refrigerant flow over a range of very small flow rates.

Changes in the capacity of the valve of the preferred invention may be readily achieved by changing the metering pin. By providing a pin with a different diameter, the effective flow area through the valve between the pin and the cylindrical portion is modified to achieve either a higher or lower flow rate.

BEST MODES FOR CARRYING OUT INVENTION

Figure 1:
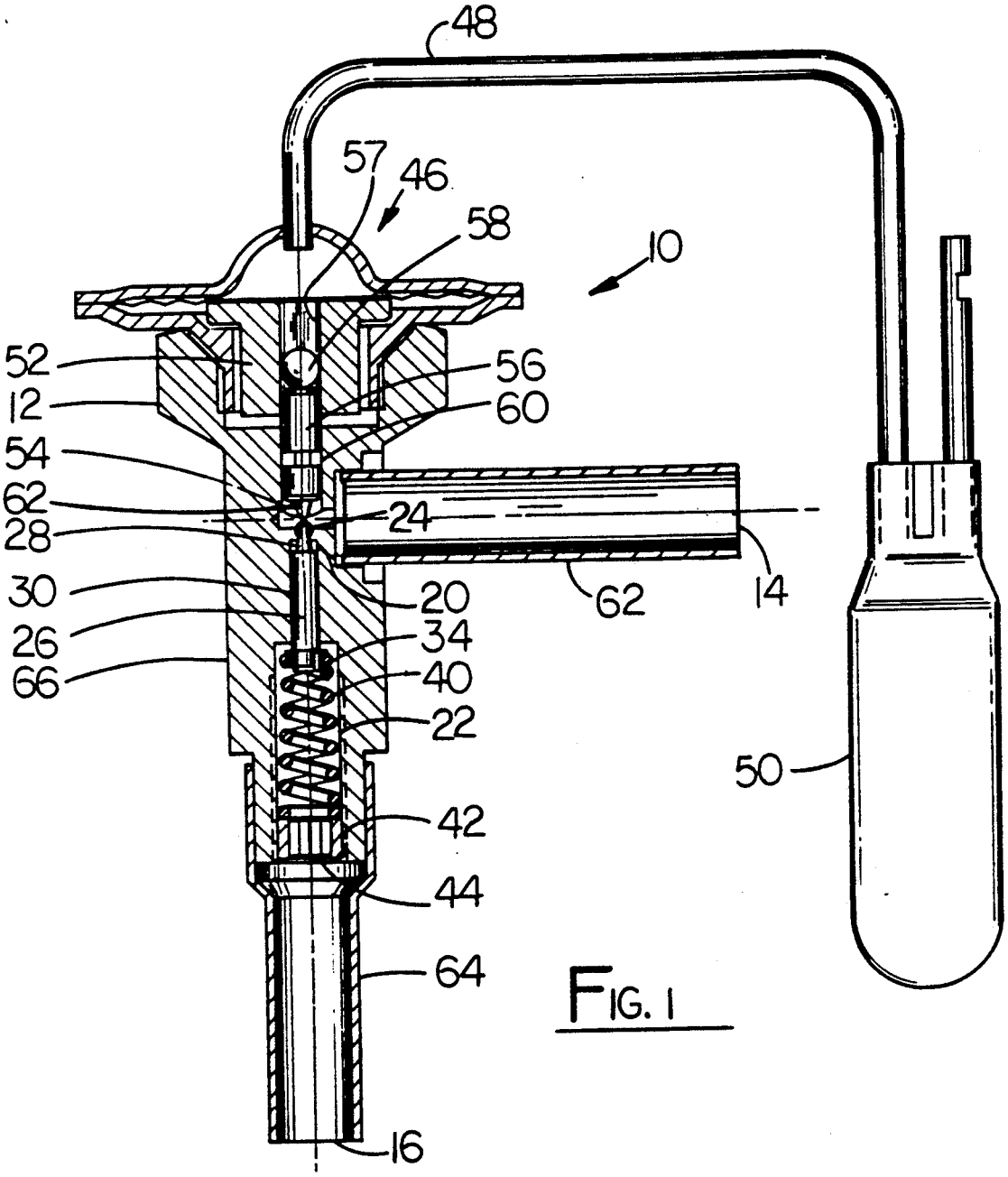
FIG. 1 is a cross sectional view of the preferred embodiment of the thermostatic expansion valve of the present invention.

Referring now to the drawings and particularly to FIG. 1, there is shown therein the preferred embodiment of the thermostatic expansion valve of the present invention generally indicated 10. The valve includes a body 12 which has a refrigerant inlet 14 and a refrigerant outlet 16.

The valve body includes a small inlet chamber 18, a cylindrical chamber 20 and an outlet chamber 22. An orifice 24 is positioned inside the body between the inlet chamber 18 and the cylindrical chamber 20. The orifice, cylindrical chamber, an outlet chamber of the valve are all coaxial.

Figure 2:
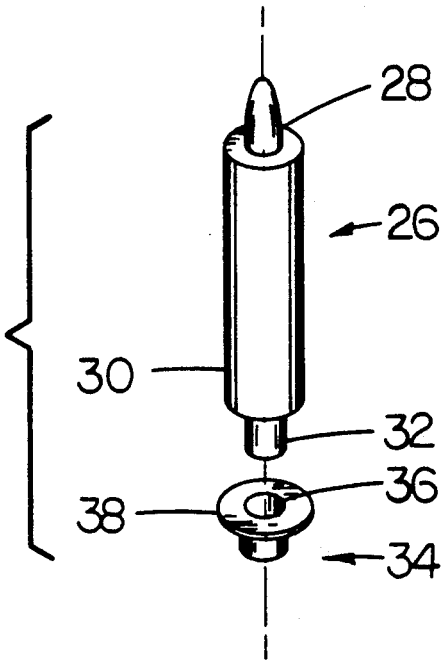
FIG. 2 is an isometric exploded view of the metering pin and the retaining member of the thermostatic expansion valve.

A metering pin 26 is positioned in cylindrical chamber 20. As best shown in FIG. 2, metering pin 26 includes a needle head portion 28 at a first end and a cylindrical body portion 30. Metering pin also includes a reduced portion 32 at a second end.

The cylindrical portion 30 of the metering pin is formed in the preferred embodiment by centerless grinding. This enables the outside diameter to be held within tolerances of plus or minus 0.0001 inches. The wall which defines the cylindrical chamber 20 in the body may be ball burnished so that the diameter of the wall of the chamber is sized to a tolerance of plus or minus 0.0002 inches.

The metering pin 26 in the preferred embodiment is precisely sized to fit in the cylindrical chamber and is movable longitudinally therein. The clearance between the pin and the wall of the chamber creates an opening. This opening, which is precisely determined by the dimensions of the cylindrical chamber and the cylindrical portion of the metering pin, determines the flow area and thus the range of refrigerant flows which may pass through the valve.

In the preferred form of the invention, the diameter of the pin is $0.0935 \pm 0.0001$ inches, and the diameter of the chamber is $0.0975 \pm 0.0002$ inches. The cylindrical body portion of the pin extends approximately 0.340 inches. This valve is suitable for use in systems having capacities of from one-tenth to one-half ton (350 to 1800 watts).

A retaining member 34 is positioned at the second end of the metering pin 26. Retaining member 34 includes a hole 36 which accepts the reduced portion 32 of the metering pin. Retaining member 34 also includes an outward extending flange portion 38.

A compression spring 40 is positioned in outlet chamber 22. Compression spring 40 is in supporting contact at a first end with the flange portion 38 of the retaining member 34. At a second opposed end, the compression spring 40 is supported by an adjusting member 42.

Adjusting member 42 includes a central opening 44 which enables refrigerant to pass therethrough. Adjusting member 42 also includes threads on its periphery that mate with threads in outlet chamber 22. Adjusting member 42 may be moved longitudinally by inserting a tool through the outlet 16 and turning the adjusting member. This enables adjustment of the force applied by spring 40 to bias metering pin 26 toward the orifice. Adjusting member 42 may also be completely removed along with spring 40, retaining member 34 and pin 26 to change the capacity of the valve as later explained.

Body 12 also includes a conventional power element assembly generally indicated 46. Power element assembly 46 includes a diaphragm. The area above the diaphragm is connected through a tube 48 to a thermal bulb 50 filled with refrigerant. The area below the diaphragm is connected through a passage (not shown) in body 12 to outlet chamber 22. As a result, the pressure in the outlet chamber tends to balance a portion of the pressure in the thermal bulb. The power element assembly 46 serves as movement means operating to position a bushing 52 in response to the temperature sensed at the thermal bulb. The operation of such a power element assembly is well known to those skilled in the art.

Body 12 further includes a piston chamber 54 which is coaxial with orifice 24 and cylindrical chamber 20. A movable piston 56 is mounted for movement in the piston chamber and is accepted at a first end into a hole 57 in bushing 52. Piston 56 is moveable in hole 57. A ball 58 is positioned in hole 57 and is fixed therein to set a point at which movement of the bushing by the power element moves the piston. A o-ring 60 is positioned adjacent to the outside of the piston to prevent passage of refrigerant around the piston.

The piston further includes a pointed conical portion 62 at a second end thereof. The pointed conical portion 62 of the piston extends through the inlet chamber 18 to the needle head 28 of the metering pin. The movement of the piston toward the metering pin moves the metering pin downward as shown in FIG. 1 against the biasing force of spring 40.

In the preferred form of the invention, body 12 of the valve also includes an inlet fitting 62 which includes inlet 14, and an outlet fitting 64 which includes outlet 16. Fittings 62 and 64 are brazed to a central body portion 66 of the valve. In the preferred form of the invention, fittings 62 and 64 are copper which facilitates attaching the valve to copper refrigerant lines.

In operation the valve is used in a conventionally configured refrigeration system having an evaporator, a compressor and a condenser. Refrigerant ready for expansion is supplied from the condenser to the inlet 14. The thermal bulb is positioned near the outlet of the evaporator. The power element assembly 46 operates to keep the refrigerant superheated at the thermal bulb so that no liquid refrigerant reaches the compressor. The compressor may be damaged if liquid is introduced into it.

The thermostatic expansion valve operates in the conventional manner to maintain the refrigerant leaving the evaporator of the refrigeration system in a consistently superheated condition. Because the power element has the pressure generated by the temperature of the refrigerant in the closed thermal bulb applied above the diaphragm, and the pressure of the outlet of the valve (and the evaporator) applied below, the power element will assert a downward force only when the pressure generated by the bulb is higher than the pressure of the valve outlet. This will occur only when the refrigerant temperature sensed by the bulb is above the saturation pressure, which is the pressure of the refrigerant leaving the valve. As the bulb is positioned near the outlet of the evaporator, a downward force is applied to the diaphragm of the power element only when the temperature of the refrigerant at the outlet of the evaporator is in the superheated range.

If the temperature sensed at the thermal bulb is sufficiently high so that more refrigerant can be passed through the valve and evaporator, while still maintaining the refrigerant leaving the evaporator in a superheated state, the diaphragm of power element 46 applies sufficient force to move piston 56 downward as shown in FIG. 1. The piston moves metering pin 26 downward, moving needle head 28 away from orifice 24. Refrigerant is thereby enabled to flow through the orifice. When the temperature sensed at the thermal bulb indicates that the refrigerant is not sufficiently superheated, the piston 56 does not apply enough force to the metering pin and it is biased by spring 40 to a position adjacent the orifice. As a result flow through the orifice is blocked. Thus, the needle head serves as a metering member controlling the flow of refrigerant through the orifice.

Refrigerant passing through the orifice enters cylindrical chamber 20 and passes through the small precisely sized opening between the outer wall of the cylindrical portion 30 of the metering pin, and the inner wall of chamber 20. Because the chamber and pin are relatively long, any local irregularities in their dimensions do not affect the overall effective flow area through the opening. As a result, the flow area may be closely set by sizing the pin and the chamber.

From the cylindrical chamber of the valve 20, refrigerant passes through the outlet chamber 22, through opening 44 in the adjusting member 42, and out of the valve through outlet 16.

In the preferred form of the thermostatic expansion valve, the needle head 28 and the cylindrical portion 30 are parts of an integral metering pin 26. This simplifies the construction and presents advantages. However in other embodiments, the metering member and cylindrical portion may be separate components.

An advantage of the present invention is that the valve maintains the refrigerant leaving the evaporator in a consistent superheated state, but the superheat may also be readily adjusted. It will be understood by those skilled in the art that in operation of the power element assembly, the pressure generated by the temperature of the thermal valve must overcome the opposing forces of the pressure at the valve outlet and the biasing force of spring 40. As a result, the superheated condition that must be sensed at the thermal bulb to enable refrigerant flow through the valve remains relatively constant.

By turning adjusting member 42, the biasing force applied by spring 40 is changed. As a result, the temperature that must be present at the thermal bulb to overcome the opposing forces and enable refrigerant flow through the valve is also changed. The preferred form of the valve thus enables changing the superheat of the refrigerant leaving the evaporator. This feature enables the preferred embodiment of the invention to be used in various types of refrigeration and air conditioning systems.

A further advantage of the preferred form of the present invention is that the capacity of the valve may be readily adjusted. This is done by removing adjusting member 42 through the outlet 16. Once adjusting member 42 is removed; spring 40, retaining member 34 and pin 26 are removed. A substitute pin with a cylindrical portion having a different diameter is then installed. If the diameter of the cylindrical portion is smaller, the opening between the pin and the wall of the cylindrical chamber is greater. As a result, the effective area through the valve will be larger resulting in valve operating over a refrigerant flow range that is higher. Conversely, if the diameter of the cylindrical portion is made larger, the opening between the chamber wall and the metering pin is smaller and the flow rates would be lower. As a result, the valve construction may be adopted for use in systems requiring differing flow rates.

Thus, the new thermostatic expansion valve achieves the above stated objectives, eliminates difficulties encountered in the use of prior devices, solves problems and obtains the desirable results described herein.

In the foregoing descriptions, certain items have been used for brevity, clarity and understanding, however no unnecessary limitations are to be implied therefrom because such terms are for descriptive purposes and are intended to be broadly construed. Moreover, the descriptions and illustrations are by way of examples and the invention is not limited to the details shown and described.

Having described the features, discoveries and principles of the invention, the manner in which it is constructed and operated and advantages and useful results obtained; the new and useful structures, devices, elements, arrangements, parts, calculations, systems, equipment, operations and relationships are set forth in the appended claims.

I claim:

1. A thermostatic expansion valve for controlling the flow of refrigerant material at low flow rates, comprising:

a body, said body including an inlet and an outlet, said body further including an orifice intermediate said inlet and outlet, and a cylindrical chamber intermediate said orifice and said outlet, said cylindrical chamber including an inner wall;

a movable pin member in said body;

means for moving said pin member; and retaining means for supporting said pin member;

said pin member including a head portion at a first and adjacent said orifice, said head portion moveable into blocking relation of said orifice to control flow therethrough;

said pin member further including a cylindrical portion extending in said cylindrical chamber of said body, said cylindrical portion substantially coaxial with said chamber, said cylindrical portion having an outer wall adjacent but slightly disposed from the inner wall of the cylindrical chamber, whereby an opening is formed, said refrigerant material flowing through said opening;

said pin member further including a second end opposed to said first end, said second end extending from said cylindrical chamber and including a reduced diameter portion;

said retaining means comprising a retaining member for accepting said reduced diameter portion of said pin member.

2. The valve according to claim 1 wherein said retaining means further includes biasing means for biasing the pin member towards the orifice.

3. The valve according to claim 2 wherein said body further includes an outlet chamber intermediate said cylindrical chamber and the outlet, and said biasing means is a compression spring positioned in the outlet chamber.

4. The valve according to claim 3 wherein the compression spring is in supporting contact with the retaining member at a first end, and further comprising an adjusting member at a second end of the spring, said adjusting member movable to control the force applied by said spring, said adjusting member accessible through said outlet.

5. The valve according to claim 4 wherein the means for moving said pin member includes a movable piston mounted for movement in said valve body, said piston coaxial of said pin member and in contact with said head portion of said pin member.

6. The valve according to claim 5 wherein said piston is in operative connection with a power element assembly, whereby said power element assembly moves said piston.

7. The valve according to claim 6 wherein said body further includes an inlet chamber intermediate of said inlet and the orifice, and wherein said piston further comprises a pointed conical portion adjacent said head portion of said pin member, whereby refrigerant is enabled to pass from said inlet chamber around said pointed conical portion through said orifice.

8. The valve according to claim 4 wherein said adjusting member, compression spring, retaining member and pin member are removable through said outlet.

9. The valve according to claim 1 wherein the outer wall of said pin member and inner wall of said cylindrical chamber extend adjacent in said valve a distance greater than a diameter of said chamber.

* * * * *

UNITED STATES PATENT AND TRADEMARK OFFICE

CERTIFICATE OF CORRECTION

PATENT NO. : 5,026,022

DATED : June 25, 1991

INVENTOR(S) : Clifford F. Bastle

It is certified that error appears in the above-identified patent and that said Letters Patent is hereby corrected as shown below:

Claim 1, Column 6, line 26, the word "and" should be --end--.

Signed and Sealed this

Seventeenth Day of November, 1992

*Attest:*

DOUGLAS B. COMER

*Attesting Officer*

*Acting Commissioner of Patents and Trademarks*